US006039563A

United States Patent [19]

Hardy

[11] Patent Number: 6,039,563

[45] Date of Patent: Mar. 21, 2000

[54] STACKABLE HEXAGONAL CANDLE HOLDERS

[75] Inventor: Christopher Hardy, Springfield, Ill.

[73] Assignee: Design Ideas, Ltd., Springfield, Ill.

[21] Appl. No.: 09/219,523

[22] Filed: Dec. 23, 1998

[51] Int. Cl.[7] ..... F23D 3/16

[52] U.S. Cl. ..... 431/291; 431/295; 206/503; 211/194; 220/4.27; 220/23.83

[58] Field of Search ..... 431/291, 289, 431/292, 295, 296, 297, 126; D26/9, 13, 14, 15; 206/503, 504, 505, 507; 362/249, 252, 447, 392; 211/194; 220/4.26, 4.27, 507, 23.83, 23.86

[56] References Cited

U.S. PATENT DOCUMENTS

| | | | |
|---|---|---|---|
| D. 192,259 | 2/1962 | Baron | D26/13 |
| D. 262,913 | 2/1982 | Glass | D26/13 |
| D. 280,443 | 9/1985 | Boss | D26/9 |
| D. 371,213 | 6/1996 | Hardy et al. | D26/9 |
| 932,772 | 8/1909 | Fleck | 362/162 |
| 2,115,962 | 5/1938 | Orme | 431/295 |
| 2,621,503 | 12/1952 | Schaefer | 431/295 |
| 2,795,124 | 6/1957 | Bruce | 431/295 |
| 3,554,384 | 1/1971 | DeNatale | 211/194 |
| 3,695,458 | 10/1972 | Nagel | 431/295 |
| 3,929,230 | 12/1975 | Luthi | 211/194 |
| 3,932,113 | 1/1976 | Thrush | 431/289 |
| 4,406,616 | 9/1983 | Greenvourcel | 431/295 |
| 4,890,206 | 12/1989 | Lee | 362/392 |
| 5,285,907 | 2/1994 | Franchere et al. | 211/194 |
| 5,660,281 | 8/1997 | James | 431/295 |
| 5,752,608 | 5/1998 | Dingeldein | 211/194 |
| 5,772,424 | 6/1998 | Nokelainen | 431/291 |

*Primary Examiner*—Ira S. Lazarus
*Assistant Examiner*—Josiah C. Cocks
*Attorney, Agent, or Firm*—Saidman DesignLaw Group

[57] ABSTRACT

A candle holding bowl has an upwardly facing hexagonal annulus joined to a downwardly facing hexagonal annulus. The upper annulus has a substantially hexagonal opening for entry into the bowl, and the lower annulus is closed by a hexagonal bottom wall. The hexagonal bottom wall of one bowl fits within the hexagonal opening of another identical bowl to permit vertical stacking of two bowls. Each hexagonal annulus comprises a plurality of flat panes which coact with each other for stacking a plurality of bowls in triangular or pyramidal fashion.

11 Claims, 6 Drawing Sheets

STACKABLE HEXAGONAL CANDLE HOLDERS

BACKGROUND OF THE INVENTION

1. Field of The Invention

This invention relates to candle holders and, more particularly, relates to a stackable candle holder in which a plurality of identical candle holding bowls are designed such that they may be stacked in a variety of pleasing arrangements.

2. Description of Related Art

Stackable candle holding bowls have been the subject of prior art patents, but they have been of a variety which either partially or totally occluded the openings above the candles, a dangerous if not inefficient situation. Representative of these patents are U.S. Pat. No. Des. 262,913 to Glass and U.S. Pat. No. 3,932,113 to Thrush.

The patent to Glass discloses cylindrical candle holders in which the cylindrical wall has been extended at the base and pairs of slots are cut therethrough. The slots receive the upper cylindrical rim of a pair of lower holders therein to interlock three or more holders together in triangular form. The arrangement necessarily forces the upper holders to protrude into the chimney of the lower holder, constricting the access thereto for inserting and/or removing a candle. Further, the heat from the lower candles impinges, deleteriously, on the upper holders. In the present invention, the holders for the candles are not subject to this disadvantage.

The patent to Thrush discloses a candle holder having a base which fits within the candle receiving opening of a similarly shaped candle holder. Vertical stacking is permitted, but only one spire holding only one candle is possible. The present invention permits horizontal and vertical expansion for innumerable arrangements holding as many candles as one desires.

OBJECTS AND SUMMARY OF THE INVENTION

The present invention overcomes the disadvantages described above by providing a candle holding bowl in which the body thereof is formed with a plurality of upwardly facing planar surfaces or panes and a plurality of downwardly facing planar surfaces, all of which have the same included angle with the planar base of the bowl. In a stacked array involving a plurality of lower bowls and at least one upper bowl, the lower bowls' upwardly facing planar surfaces will mate with the upper bowl's downwardly facing planar surfaces to support the upper bowl.

It is an object of the invention to provide a candle holding bowl which is attractive when used alone and yet has the capability, with a plurality of identical bowls, to be stacked to form a spectacular candle display.

It is a further object of the invention to provide a candle holding bowl which, when stacked with a plurality of identical bowls, the openings at the top of each bowl are not partially or fully blocked by higher bowls.

BRIEF DESCRIPTION OF THE DRAWINGS

The foregoing and other objects, aspects, uses, and advantages of the present invention will be more fully appreciated as the same becomes better understood from the following detailed description of the present invention when viewed in conjunction with the accompanying drawings, in which.

DETAILED DESCRIPTION OF THE PREFERRED EMBODIMENT

Figure 1:
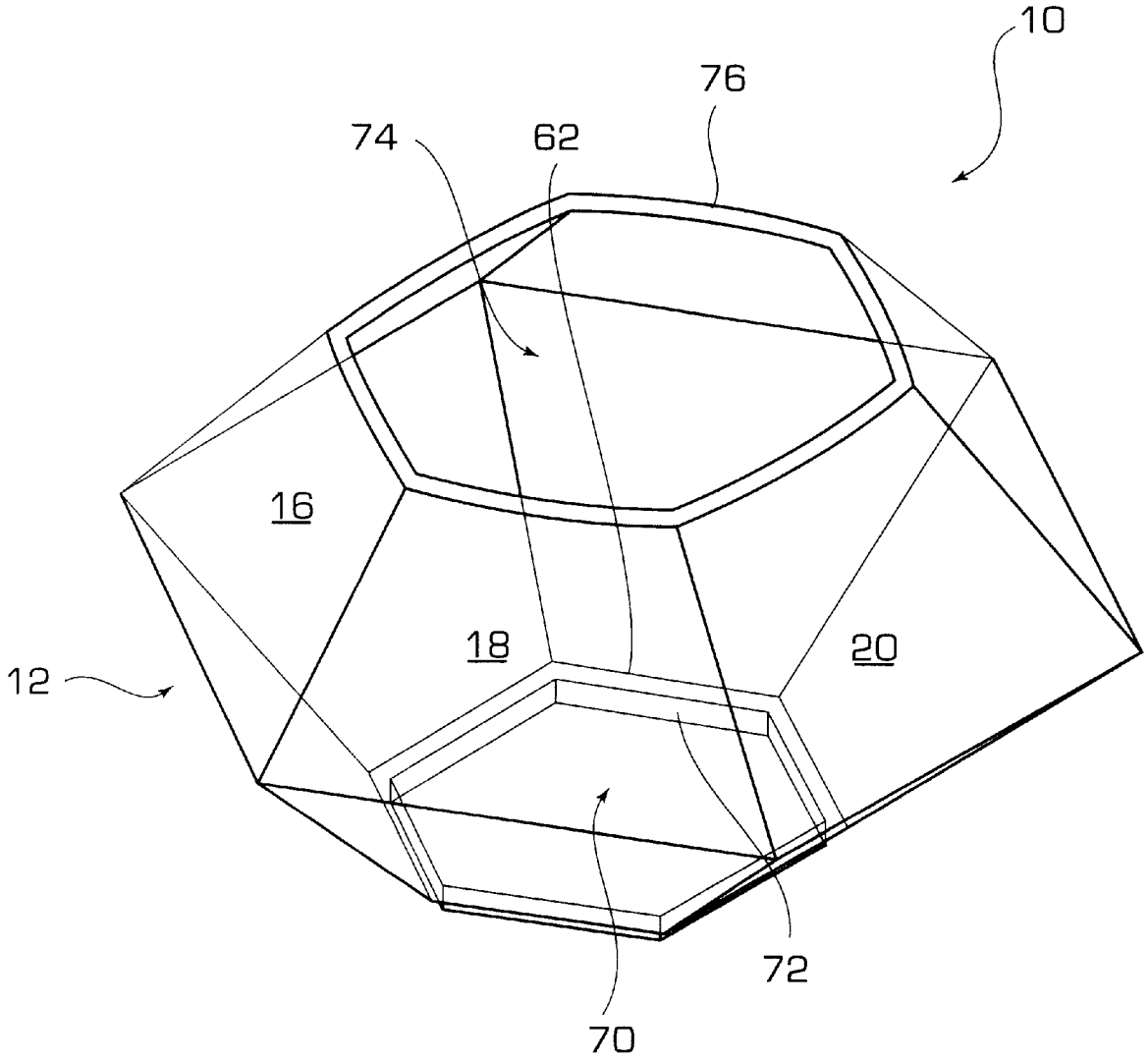
FIG. 1 is a perspective view which illustrates the preferred embodiment of the present invention.

Referring to FIGS. 1–5, reference numeral 10 generally indicates a preferred embodiment of the candle holder of the present invention in the form of a hexagonal bowl 12. Bowl 12 is shown as being transparent for ease of discussion, but it could be translucent (e.g., frosted), cloudy, colored with a single color or a rainbow of colors, or include embedded therein disparate decorative materials, e.g., sparkles, geometrical shapes, or recognizable images (not shown). Bowl 12 is preferably made of glass whose panes are joined to form a fixed, unitary structure.

Figure 2:
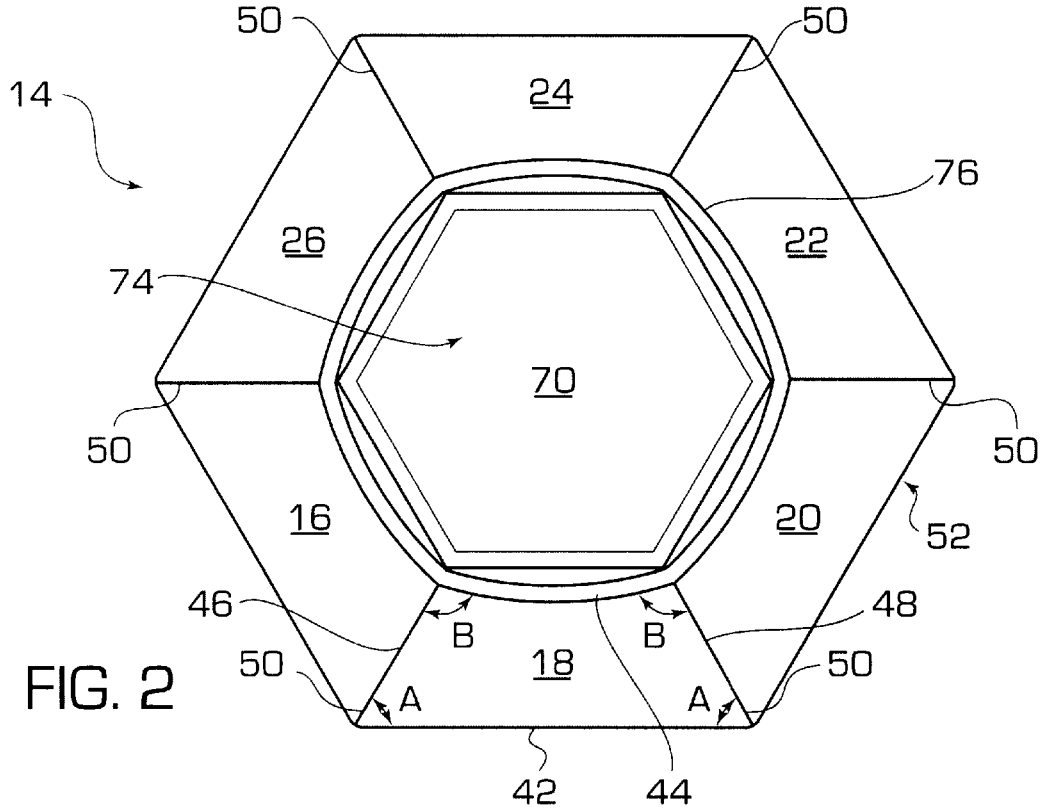
FIG. 2 is a top view of the candle holder of FIG. 1.
Figure 3:
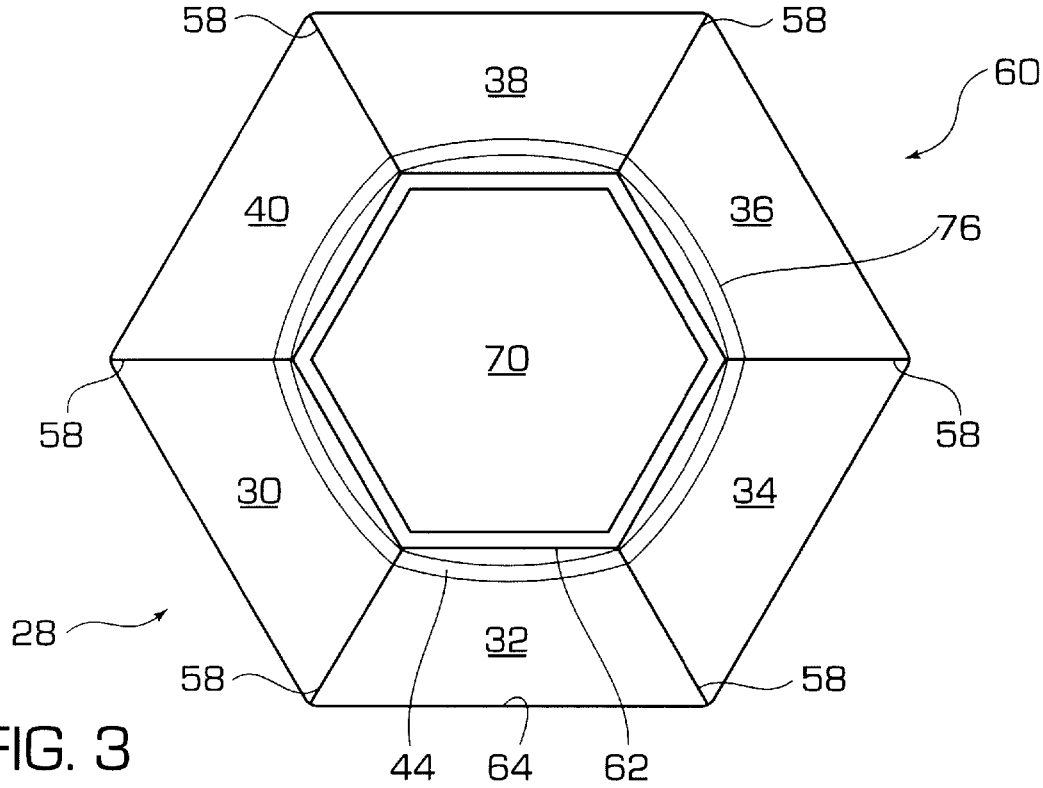
FIG. 3 is a bottom view of the candle holder of FIG. 1.

Bowl 12 is composed of an upper set 14 of six flat panes 16, 18, 20, 22, 24 and 26 (FIG. 2) and a lower set 28 of six flat panes 30, 32, 34, 36, 38, and 40 (FIG. 3). All of the panes are identical in size and shape; the preferred shape is trapezoidal. Since the panes are identical, for the purpose of maintaining clarity of the drawings, only pane 18, the one facing forward in FIGS. 1, 2, and 4, will be described in detail.

Figure 4:
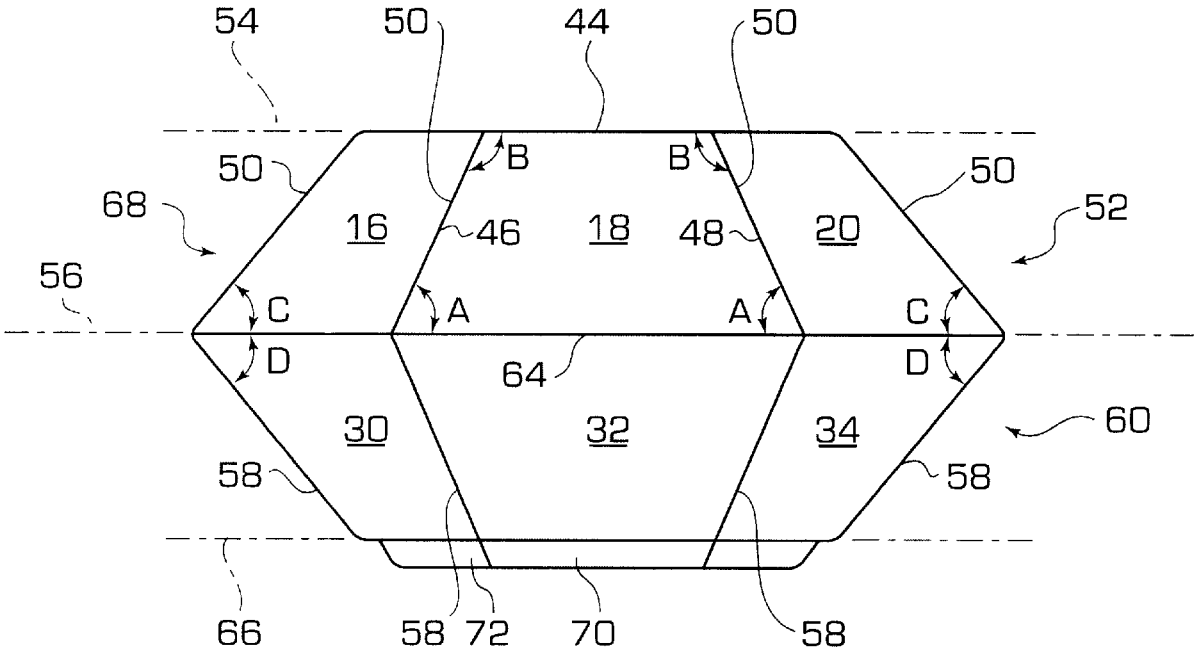
FIG. 4 is a side view of the candle holder of FIG. 1.

Referring to FIGS. 2 and 4, pane 18 comprises a base edge 42, a top edge 44, and a pair of side edges 46 and 48. Each of the side edges 46 and 48 are connected to base edge 42 and top edge 44. Base and side edges 42, 46, and 48 are preferably straight, but top edge 44 may be either straight or slightly arcuate, as shown in FIGS. 2–3, if desired. The included angle A between base edge 42 and each of side edges 46 and 48 is preferably 60°, and the included angle B between top edge 44 and each of side edges 46 and 48 is preferably 120°.

Figure 5:
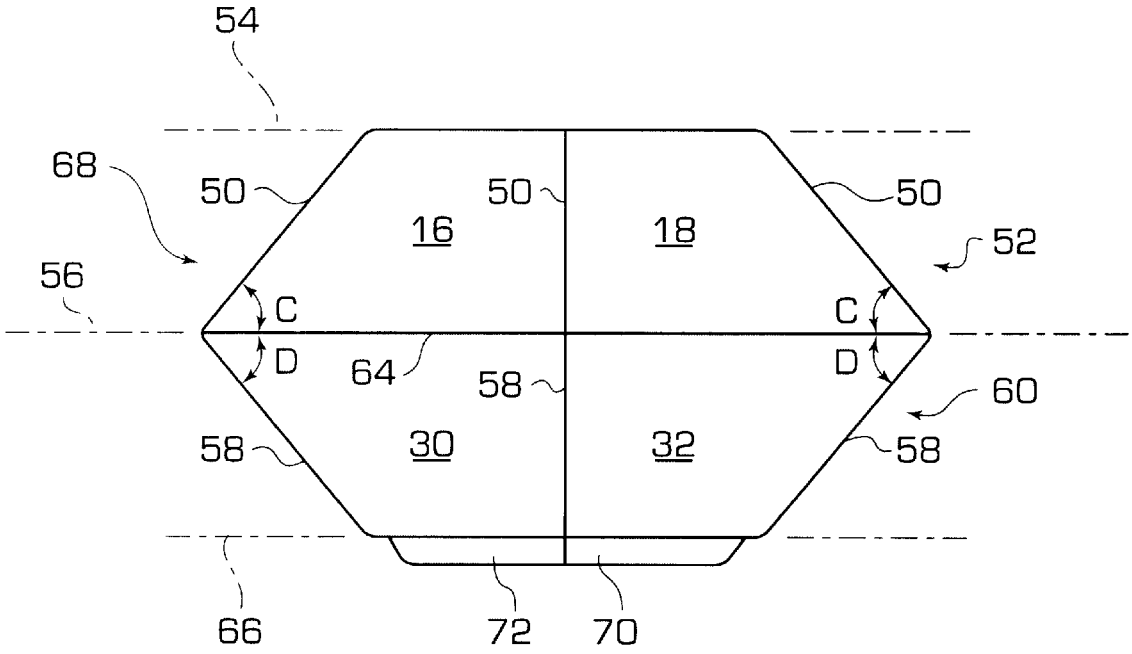
FIG. 5 is another side view of the candle holder of FIG. 1.

When the side edges 46 of each pane 16–26 are joined to the side edges 48 of each adjacent pane, corners 50 are formed. The angles discussed above insure that the upper set of panes 14 will then fit together to form an upper hexagonal annulus 52 (FIGS. 2 and 4–5) whose top edges 44 lie in a plane 54 and whose base edges 42 lie in a second plane 56 parallel to plane 54. Lower panes 28 are identical in size and shape to upper panes 14 and are joined together at corners 58 in a like manner (FIGS. 3–5) to form a lower hexagonal annulus 60 having planar top edges 62 and planar base edges 64 (see pane 32 of FIGS. 3–4). When lower hexagonal annulus 60 is inverted and the base edges 64 of lower panes 30–40 are joined to base edges 42 of upper panes 16–36, respectively, their junction coincides with plane 56 (FIGS. 4–5). Top edges 62 of annulus 60 are straight and define a third plane 66 parallel to both planes 54 and 56.

The joined annuli 52 and 60 integrally form a sidewall 68 for bowl 12 with upper annulus 52 facing upwardly and lower annulus 60 facing downwardly. As a consequence of all the panes 16–26 and 30–40 being identical in size and shape, the included angles C between corners 50 and plane 56 and included angles D between corners 58 and plane 56, will be equal (see FIGS. 4–5). This is important to the stacking capabilities of bowl 12.

A hexagonal bottom wall 70 closes the bottom of bowl 12. Bottom wall 70 may be cup-shaped (FIG. 1) with its sidewall 72 joined to top edges 62 of lower panes 28 at plane 66. Bottom wall 70 therefore extends below plane 66 of lower hexagonal annulus 60, as clearly seen in FIGS. 4 and 5.

Figure 6:
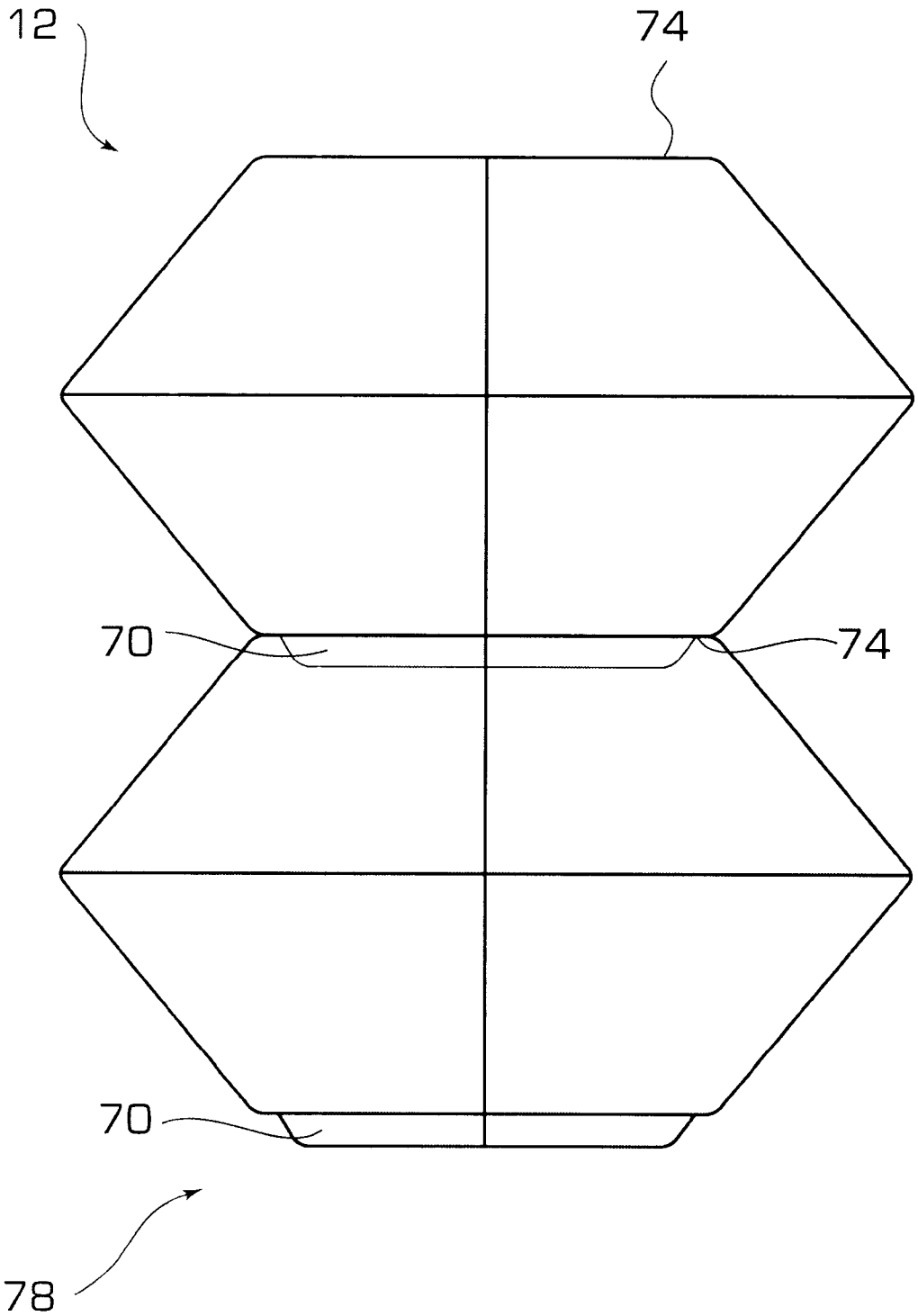
FIG. 6 is a front view of two of the candle holders stacked vertically.

When upper panes 14 are joined together, top edges 44 (shown as slightly arcuate in FIGS. 1–3) form an opening 74 having a hexagonal perimeter 76. Top opening 74 is slightly larger than hexagonal bottom wall 70, as can be seen most clearly in FIGS. 2 and 3, in order for bottom wall 70 to fit closely within a similar top opening in an identical bowl for vertical stacking thereof. FIG. 6 shows two such bowls 12 and 78 stacked vertically by placing bottom wall 70 of bowl 12 through opening 74 of bowl 78. Bowl 78 may not be suitable, when stacked as shown, for enclosing a lighted candle, but other materials may be placed therein to create pleasing effects by reflecting the light of a candle placed in bowl 12.

Figure 7:
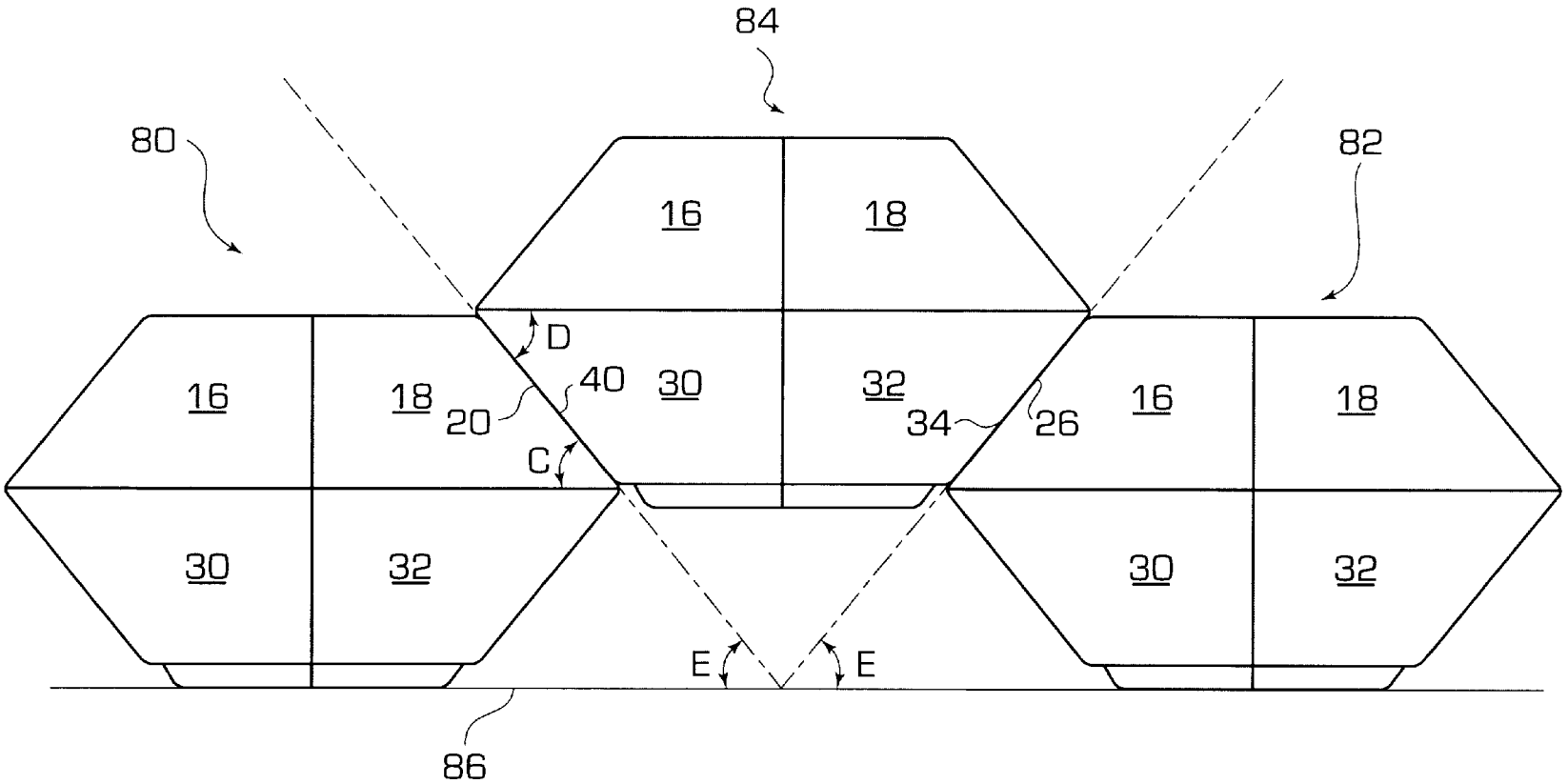
FIG. 7 is a front view of three of the candle holders triangularly stacked.

Because angles C and D (FIGS. 4–5) are equal, equally sized bowls 12 are capable of being stacked in a variety of orientations. As seen in FIG. 7, three bowls 80, 82, and 84 are stacked in a generally triangular configuration. Bowls 80 and 82 rest on a supporting surface 86 with their exposed surfaces designated with the same reference numerals used in FIGS. 1–5. Bowl 84 is supported by bowls 80 and 82 by means of pane 40 of bowl 84 resting on pane 20 of bowl 80 and pane 34 of bowl 84 resting on pane 26 of bowl 82. Inasmuch as angles C and D are equal and planes 54, 56, and 66 are parallel, the acute angle E which the planes of all panes 16–36 and 30–40 make with support surface 86 are equal to each other and to angles C and D; i.e., C=D=F, as can be seen in FIG. 7. The surfaces of the contacting panes are, therefore, in close, contiguous, supporting relationship with each other when a plurality of bowls 12 are stacked.

Figure 8:
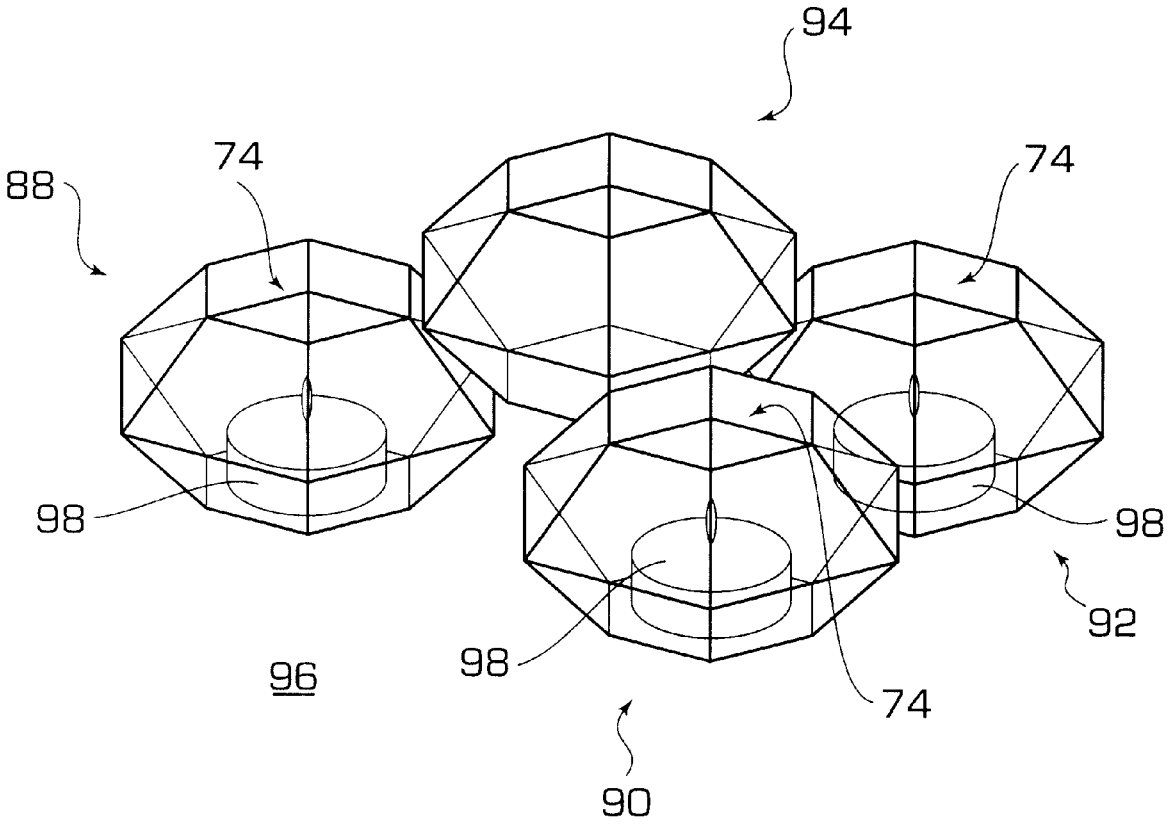
FIG. 8 is a perspective view of four of the candle holders stacked in the general form of a pyramid.

FIG. 8 shows how a plurality (four in this case) of substantially identical bowls 12 can be stacked in a pyramidal array. Lower bowls 88, 90 and 92 are located on a supporting surface 96 and an upper bowl 94 is supported by lower bowls 88–92. In this configuration, the supporting surfaces are pane 20 of bowl 88, pane 24 of bowl 90, and pane 16 of bowl 92 which receive panes 40, 32, and 36, respectively, of upper bowl 94. Candles 98 can be placed in any of bowls 12 without having the openings 74 thereof occluded by any other bowl.

A five bowl array (not shown) would find panes 16, 20, 22, and 26 of four to rectangularly-oriented lower supporting bowls in contact, respectively, with panes 36, 40, 30, and 34 of a supported upper bowl. It is easy to see how the number of bowls could be increased to include any number practicable to build an enlarged, three-dimensional pyramid and create a spectacular light display.

A hexagonal bowl has been described. It is apparent that candle holding bowls of a different number of panes could be constructed. The critical relationship is that all of the panels be of the same size and shape to form identically sloping annuli.

Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention as defined in the appended claims.

Further, the purpose of the Abstract is to enable the U. S. Patent and Trademark Office, and the public generally, and especially the scientists, engineers to and practitioners in the art who are not familiar with patent or legal terms or phraseology, to determine quickly from a cursory inspection the nature and essence of the technical disclosure of the application. The Abstract is neither intended to define the invention of the application, which is measured solely by the claims, nor is intended to be limiting as to the scope of the invention in any way.

I claim as my invention:

1. A candle holder, comprising:

a first set of flat panes joined edge to edge to form an upwardly facing annulus, said upwardly facing annulus comprising an upper edge defining a first plane with an upwardly facing opening therethrough;

a second set of flat panes joined edge to edge to form a downwardly facing annulus, said downwardly facing annulus comprising a lower edge defining a second plane with a downwardly facing opening therethrough;

said first annulus and said second annulus being joined together at a third plane; and a bottom wall closing said downwardly facing opening along said second plane;

said first, second, and third planes being substantially parallel;

the angles that each of said panes of said first and second set of flat panes forms with any one of said planes being equal to each other; and wherein said first set of flat panes and said second set of flat panes are joined so as to form a fixed, unitary structure.

2. The candle holder of claim 1 wherein each of said panes are substantially trapezoidally shaped.

3. The candle holder of claim 2 wherein said first and second sets of panes each comprise six panes.

4. The candle holder of claim 1 wherein said upwardly facing opening is slightly larger than said bottom wall.

5. The candle holder of claim 1 wherein said upwardly facing opening is substantially hexagonal.

6. The candle holder of claim 5 wherein said bottom wall is hexagonally shaped and said upwardly facing opening is slightly larger than said bottom wall.

7. A set of stackable candle holders, comprising:

a plurality of substantially identical candle holders, including a first lower candle holder and an upper candle holder, each candle holder comprising:

a first set of flat panes joined edge to edge to form an upwardly facing annulus, said upwardly facing annulus comprising an upper edge defining a first plane with an upwardly facing opening therethrough;

a second set of flat panes joined edge to edge to form a downwardly facing annulus, said downwardly facing annulus comprising a lower edge defining a second plane with a downwardly facing opening therethrough;

said first annulus and said second annulus being joined together at a third plane;

a bottom wall closing said downwardly facing opening along said second plane;

said first, second, and third planes being parallel;

the angles that each of said panes of said first and second set of flat panes forms with any one of said planes being equal to each other;

wherein each of said plurality of substantially identical candle holders comprises a fixed, unitary structure; and said plurality of candle holders are capable of being stacked.

8. The set of stackable candle holders as in claim 7 wherein said upwardly facing opening is slightly larger than said bottom wall such that the bottom wall of said upper candle holder will fit within said upwardly facing opening of said lower candle holder, said first lower candle holder being positioned below said upper candles holder.

9. The set of stackable candle holders as in claim 7 wherein said plurality of candle holders further comprises a second lower candle holder, said first and second lower candle holders supporting said upper candle holder by resting one of the panes of said downwardly facing annulus of said upper candle holder on one of said panes of said upwardly facing annulus of said first lower candle holder and by resting one of the panes of said downwardly facing annulus of said upper candle holder on one of said panes of said upwardly facing annulus of said second lower candle holder.

10. The set of stackable candle holders as in claim 9 wherein said plurality of lower candle holders comprises three candle holders.

11. A candle holder, comprising:

a first set of six flat panes joined edge to edge to form an upwardly facing annulus, said upwardly facing annulus comprising an upper edge defining a first plane with an upwardly facing opening therethrough;

a second set of six flat panes joined edge to edge to form a downwardly facing annulus, said downwardly facing annulus comprising a lower edge defining a second plane with a downwardly facing opening therethrough;

said first annulus and said second annulus being joined together at a third plane;

a bottom wall closing said downwardly facing opening along said second plane;

said first, second, and third planes being substantially parallel; and wherein said first set of six flat panes and said second set of six flat panes are joined to form a fixed, unitary structure.

* * * * *